US006616016B2

(12) United States Patent
Hicks et al.

(10) Patent No.: US 6,616,016 B2
(45) Date of Patent: Sep. 9, 2003

(54) CLOSURE WITH PRESSURE-ACTUATED VALVE AND LID SEAL

(75) Inventors: Marge M. Hicks, Eagle, WI (US); Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/008,794

(22) Filed: Dec. 7, 2001

(65) Prior Publication Data

US 2003/0106910 A1 Jun. 12, 2003

(51) Int. Cl.[7] ..... B65D 37/00
(52) U.S. Cl. ..... 222/212; 222/494; 222/490
(58) Field of Search ..... 222/95, 212, 213, 222/214, 215, 496, 494, 550, 490, 493

(56) References Cited

U.S. PATENT DOCUMENTS

| | | | | | |
|---|---|---|---|---|---|
| 4,133,457 | A | * | 1/1979 | Klassen | 222/212 |
| 5,115,950 | A | | 5/1992 | Rohr | |
| 5,271,531 | A | | 12/1993 | Rohr et al. | |
| 5,377,877 | A | * | 1/1995 | Brown et al. | 222/105 |
| 5,531,363 | A | | 7/1996 | Gross et al. | |
| 5,632,420 | A | * | 5/1997 | Lohrman et al. | 222/212 |
| 5,680,969 | A | | 10/1997 | Gross | |
| 5,769,253 | A | * | 6/1998 | Gross | 215/237 |
| 5,839,614 | A | * | 11/1998 | Brown | 222/185.1 |
| 5,924,605 | A | * | 7/1999 | Baudin et al. | 222/494 |
| 6,065,642 | A | * | 5/2000 | Brown | 222/92 |
| 6,089,411 | A | * | 7/2000 | Baudin et al. | 222/212 |
| 6,089,418 | A | * | 7/2000 | Gaiser et al. | 222/490 |
| 6,112,951 | A | * | 9/2000 | Mueller | 222/490 |
| 6,152,324 | A | * | 11/2000 | Baudin | 222/1 |
| 6,273,305 | B1 | * | 8/2001 | Fioravanti et al. | 222/494 |
| 6,279,783 | B1 | * | 8/2001 | Brown et al. | 222/185.1 |
| 6,290,108 | B1 | * | 9/2001 | Gross | 222/494 |
| 6,293,437 | B1 | * | 9/2001 | Socier et al. | 222/212 |
| 6,405,901 | B1 | * | 6/2002 | Schantz et al. | 222/213 |

OTHER PUBLICATIONS

Prior art drawings, A, B, C, D, E, and F for product shown in 1998 in U.S.

U.S. patent application Ser. No. 09/748,631, filed Dec. 22, 2000.

* cited by examiner

*Primary Examiner*—Gene Mancene
*Assistant Examiner*—F. C. Nicolas
(74) *Attorney, Agent, or Firm*—Wood, Phillips, Katz, Clark & Mortimer

(57) ABSTRACT

A dispensing valve is mounted in a dispensing aperture of a closure that has (1) a deck around the aperture, and (2) a hinged lid for closing over the aperture. The valve includes a marginal portion, a head portion with a discharge orifice therein, and a resilient, connector sleeve extending between the marginal portion to the head portion. The connector sleeve has a generally U-shaped cross-section that defines a first leg that is connected with the marginal portion and a shorter second leg connected with the head portion. The connector sleeve locates the head portion below the closed lid. An arcuate junction portion of the connector sleeve joins the first and second legs. The arcuate junction portion projects from the deck aperture when the lid is open. When the lid is closed, the arcuate junction portion is engaged and elastically deformed by the lid, and that prevents the valve orifice from opening.

13 Claims, 6 Drawing Sheets

CLOSURE WITH PRESSURE-ACTUATED VALVE AND LID SEAL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a fluent material from a container. The invention is particularly suitable for incorporation in a dispensing closure for use with a squeezable container.

BACKGROUND OF THE INVENTION AND TECHNICAL PROBLEMS POSED BY THE PRIOR ART

There are a wide variety of packages which include (1) a container, (2) a dispensing system extending as a unitary part of, or attachment to, the container, and (3) a product contained within the container. One type of such a package employs one or more dispensing valves for discharging one or more streams of product (which may be a gaseous, liquid, cream, powder, or particulate product). See, for example, U.S. Pat. No. 5,271,531 and 6,112,951. The valve is a flexible, resilient, self-sealing, slit-type valve at one end of a bottle or container which typically has resiliently flexible sidewalls which can be squeezed to pressurize the container interior. The valve is normally closed and can withstand the weight of the product when the container is completely inverted, so that the product will not leak out unless the container is squeezed. When the container is squeezed and the interior is subjected to a sufficient increased pressure so that there is a predetermined minimum pressure differential across the valve, the valve opens.

In the preferred embodiment, the valve stays open, at least until the container pressure drops below a predetermined value. Such a valve can be designed to snap closed if the pressure differential across the open valve drops below a predetermined amount. The valve can also be designed to open inwardly to vent air into the container when the pressure within the container is less than the ambient external pressure, and this accommodates the return of the resilient container wall from an inwardly squeezed condition to the normal, unstressed condition.

Such a resilient valve typically includes a central head portion which is recessed inwardly from surrounding portions of the valve which project outwardly. The U.S. Pat. No. 6,112,951 illustrates such a valve mounted in the dispensing opening of a closure body to which is hingedly attached a lid having a post 90 for projecting downwardly toward the valve head when the lid is closed. Sometimes, when a lid is closed on a closure on a container which is subjected to external forces, such as may be encountered during packing, shipping, and handling, and such external forces can temporarily increase the container internal pressure by squeezing in a portion of the container wall. The increased pressure within the container may cause the valve central head portion to move outwardly. If unrestrained, the outwardly moving central head portion of the valve eventually opens, and a small amount of the product from the container might be forced through the open valve. In order to eliminate, or at least minimize, such undesirable occurrences, the lid post prevents the valve central head from moving outwardly far enough to open. Rather, the valve central head portion, as it begins to move outwardly owing to an increased internal pressure, contacts the lid post before the valve slits can open. Thus, the valve remains sealed in such over-pressure situations.

While the use of a lid seal post functions generally satisfactorily in applications in which it is employed, a closure incorporating a lid seal post in the lid necessarily adds complexity to the lid structure. The more complex lid structure requires a more complex mold and molding technique. A requirement to include a seal post in a lid can inhibit the closure designer's design flexibility with respect to lid style, and with respect to the incorporation of other, unrelated features.

It would be desirable to provide a means for preventing the opening of a flexible valve in a closure during over-pressure conditions without requiring the use of a projecting seal post on the lid.

Further, it would be desirable if such an improved means for preventing the opening of a valve during over-pressure conditions could also generally function as a leak-proof seal for a package on which the valve-containing closure is provided.

An improved closure having a flexible valve and a lid without a seal post should also preferably accommodate a variety of lid designs that could provide other, desirable features.

It would also be beneficial if an improved dispensing closure system could readily accommodate its manufacture from a variety of different materials.

It would also be advantageous if such an improved closure system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention provides an improved dispensing closure system for a container that has an opening to the container interior. The user can easily operate the closure system to assume a closed configuration for preventing flow from the container or to assume an open configuration for permitting flow from the container.

The present invention provides an improved dispensing closure system that includes a closure body and a lid, preferably hingedly attached to the closure body, wherein the lid does not have any outwardly projecting seal post. This allows the lid to be more easily molded with less complex mold structures. In particular, the lid can be molded at an angle relative to the closure body top deck as a generally planar member to accommodate ease of molding and to reduce the complexity of the mold assembly.

According to a preferred embodiment of the invention, a dispensing closure system is provided for a container that has an opening to the container interior where a product may be stored. The dispensing closure system comprises a body extending from the container at the opening, and the body includes a deck defining an aperture. The closure system also further comprises a lid movable between a closed position confronting the deck and an open dispensing position moved away from the closed position. The dispensing closure system further comprises a dispensing valve disposed with respect to the body at the deck aperture.

The dispensing valve includes (a) a marginal portion sealingly engaged with the body and retained at the body, and (b) a head portion that (1) is laterally inwardly of the marginal portion, (2) has an exterior side for interfacing with the ambient environment, and (3) has an interior side for interfacing with the product. Further, the valve head portion includes a normally closed orifice which opens to permit flow therethrough in response to a pressure differential across the valve.

The valve also includes a resilient, flexible, connector sleeve having an interior surface for interfacing with product and having an exterior surface for interfacing with the ambient environment. The connector sleeve has (1) a first leg connected with the marginal portion, (2) a second leg connected with the head portion to locate the head portion spaced laterally inwardly of the first leg to facilitate outward movement of the head portion when dispensing product form the container, and (3) an arcuate junction portion joining the first and second legs. The arcuate junction portion has a generally outwardly protruding, convex configuration when viewed from outside of the closure body. The valve is positioned on the closure body so that the junction portion of the connector sleeve projects from the deck aperture beyond at least a portion of the deck when the valve orifice is closed but the lid is in the open dispensing position. The arcuate junction has a generally outwardly facing surface for being engaged by the lid to elastically deform the junction portion inwardly when the lid is in the closed position. This prevents the connector sleeve from rolling far enough outwardly with the head portion to a position where the valve orifice would open when subjected to a sufficient pressure differential.

The closure system can be readily incorporated as a separate assembly of components defining a closure that is separate from, but which is adapted to be mounted to, the container. Such a closure may be incorporated in an embodiment which is removably attachable to the container or which is non-removably attachable to the container.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, most of the figures illustrating the invention show a dispensing closure system in the typical orientation that it would have at the top of a container when the container is stored upright on its base, and terms such as upper, lower, horizontal, etc., are used with reference to this position. It will be understood, however, that the dispensing closure system of this invention may be manufactured, stored, transported, used, and sold in an orientation other than the position described.

The dispensing closure system of this invention is suitable for use with a variety of conventional or special containers having various designs, the details of which, although not illustrated or described, would be apparent to those having skill in the art and an understanding of such containers. In the illustrated embodiment of the invention described herein, the container, per se, as described herein forms no part of, and therefore is not intended to limit, the present invention. It will also be understood by those of ordinary skill that novel and non-obvious inventive aspects are embodied in the described exemplary closure system alone. In other embodiments that are not illustrated herein, the closure system could be formed as a unitary part, or non-removable part, of the container so that the invention could be regarded in such a case as including at least the "closure" portion of such a container.

Figure 1:
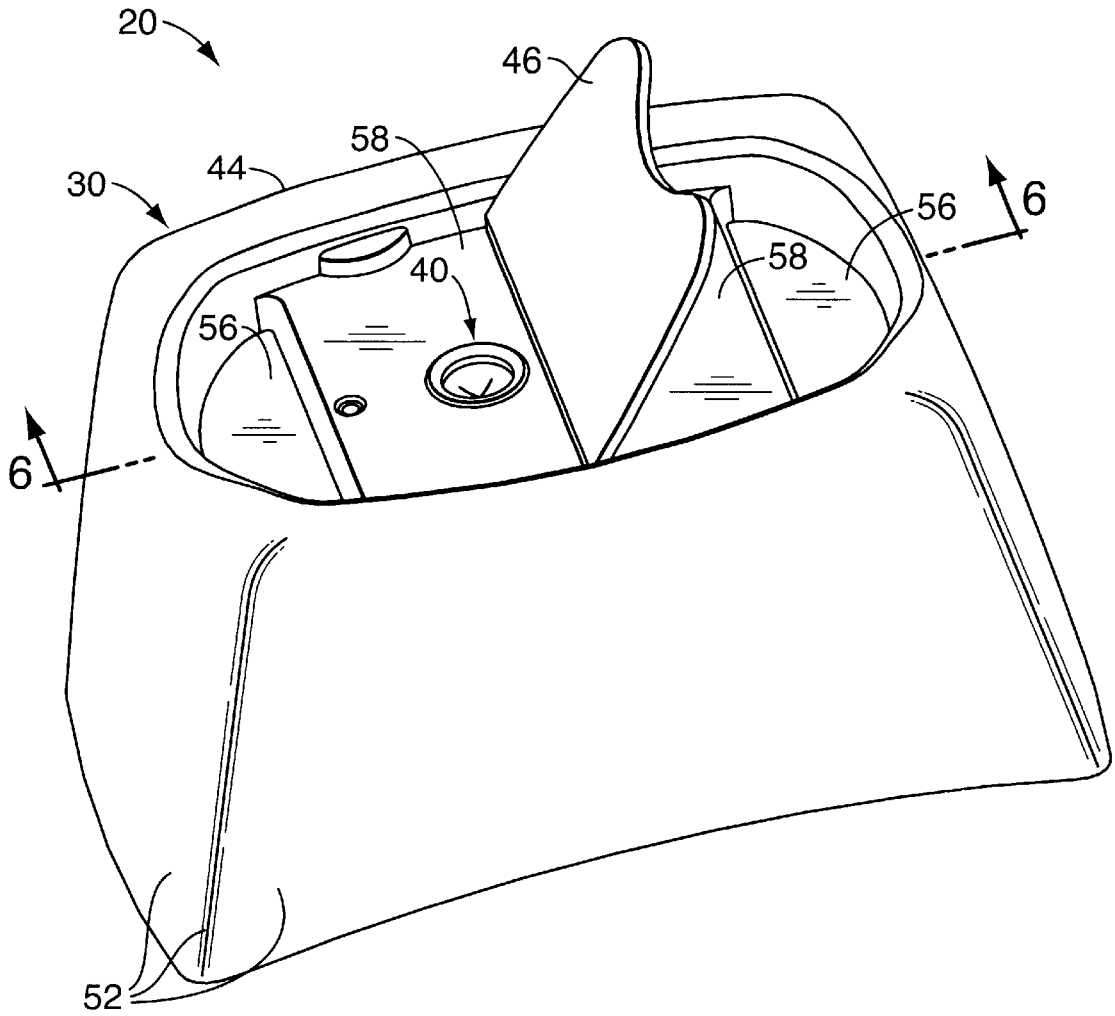
FIG. 1 is a fragmentary, perspective view of an exemplary dispensing closure system in the form of a separate dispensing closure according to a preferred embodiment of the invention, and the closure is shown in an open configuration prior to closing the lid and installing the closure on a container (not illustrated), and the closure is shown from a vantage point generally above, or from the top of, the closure.

A presently preferred embodiment of a dispensing structure or dispensing closure system of the present invention in the form of a dispensing closure assembly is illustrated in FIGS. 1–9 and is designated generally therein by reference number 20 in FIG. 1. The dispensing closure assembly 20, which is hereinafter sometimes referred to more simply as the "closure 20," is, in the preferred illustrated embodiment, provided as a separately manufactured unit or subassembly for mounting to the top of a container (not shown in FIG. 1). It will be appreciated, however, that it is contemplated that in some applications it may be desirable for the dispensing closure system of the present invention to be formed as a unitary part, or extension, of a container.

The container typically has a conventional mouth or opening which provides access to the container interior and product contained therein. The product may be, for example, a beverage such as water, or other liquid comestible product. The product could also be any other fluent material, including, but not limited to, gases, powders, particles, and liquids (including creams, lotions, slurries, pastes, etc.). Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container may typically have a neck or other suitable structure defining the container mouth. The neck may have (but need not have) a circular cross-sectional configuration, and the body of the container may have another cross-sectional configuration, such as an oval cross-sectional shape, for example. The container may, on the other hand, have a substantially uniform shape along its entire length or height without any neck portion of reduced size or different cross-section.

The container may typically be a squeezable container having a flexible wall or walls which can be grasped by the user and compressed to increase the internal pressure within the container so as to squeeze the product out of the container through the closure 20 when the closure 20 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the contents solely under the influence of gravity and/or under the influence of a reduced ambient pressure exterior of the container (e.g., as by sucking on the open closure 20).

Figure 7:
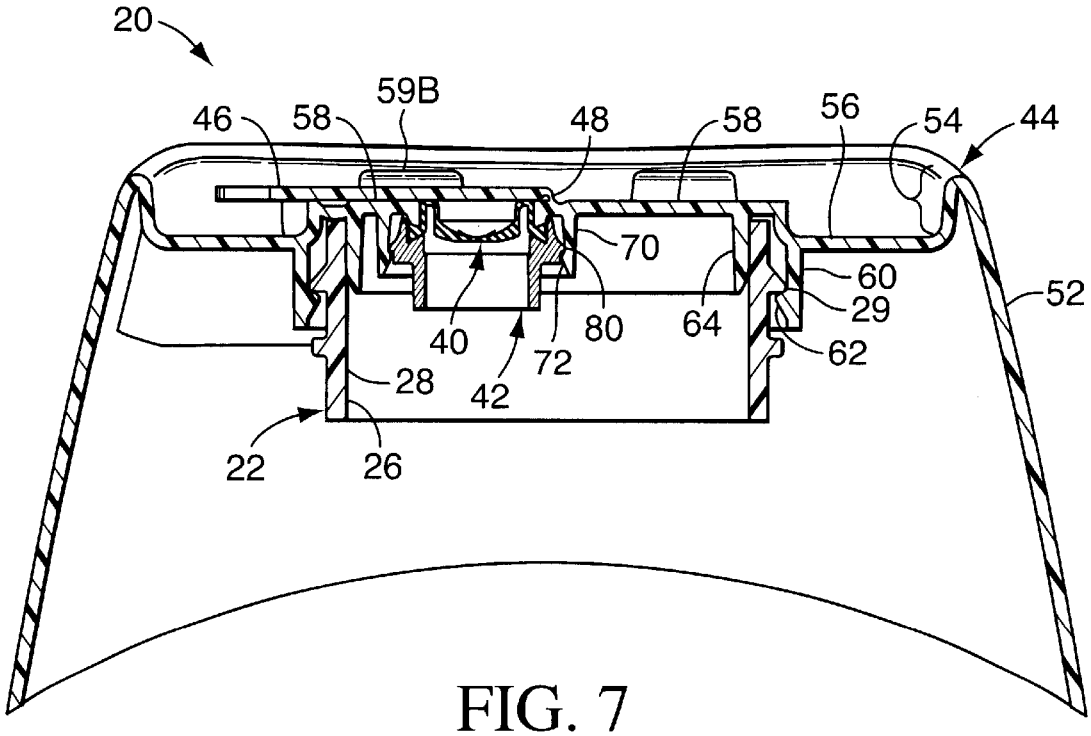
FIG. 7 is a cross-sectional view similar to FIG. 6, but FIG. 7 shows the entire closure and shows the lid in the fully closed position, and FIG. 7 also shows the closure installed on the neck of a container, a fragmentary portion of which container neck is visible in FIG. 7.

In the preferred embodiment illustrated in FIG. 7, the dispensing closure system of the present invention is provided in the form of a closure 20 which is adapted to be mounted on a container 22 (partially illustrated in FIG. 7). The container 22 could include a body portion or body having an upwardly extending neck 26 as shown in FIG. 7. The neck 26 defines an opening 28 to the container interior. The container neck 26, in the preferred embodiment illustrated in FIG. 7, has an external bead 29 for engaging the closure 20.

The body of the container 22 below the neck 26 may have any suitable configuration, and the upwardly projecting neck 26 may have a different cross-sectional size and/or shape than the container body. Alternatively, the container 22 need not have a neck 26 per se. Instead, the container 22 may consist of just a body with an opening. The container 22 may have a rigid wall or walls, or may have a somewhat flexible wall or walls.

Although the container, per se, does not necessarily form a part of the broadest aspects of the present invention, per se, it will be appreciated that at least a lower portion of the dispensing structure, system, or closure 20 of the present invention may be provided as a unitary portion, or extension, of the top of the container 22. However, in the preferred embodiment illustrated, the dispensing system or closure 20 is a separate element or assembly (e.g., a closure) which is adapted to be removably or non-removably mounted to a previously manufactured container 22 which has an opening 28 to the container interior.

It is presently contemplated that many applications employing the closure 20 will be most conveniently realized by molding some or all of the components of the closure 20 from a suitable thermoplastic and/or thermoset material or materials. The closure components may be separately molded from the same material or from different materials. The materials may have the same or different colors and textures.

Figure 2:
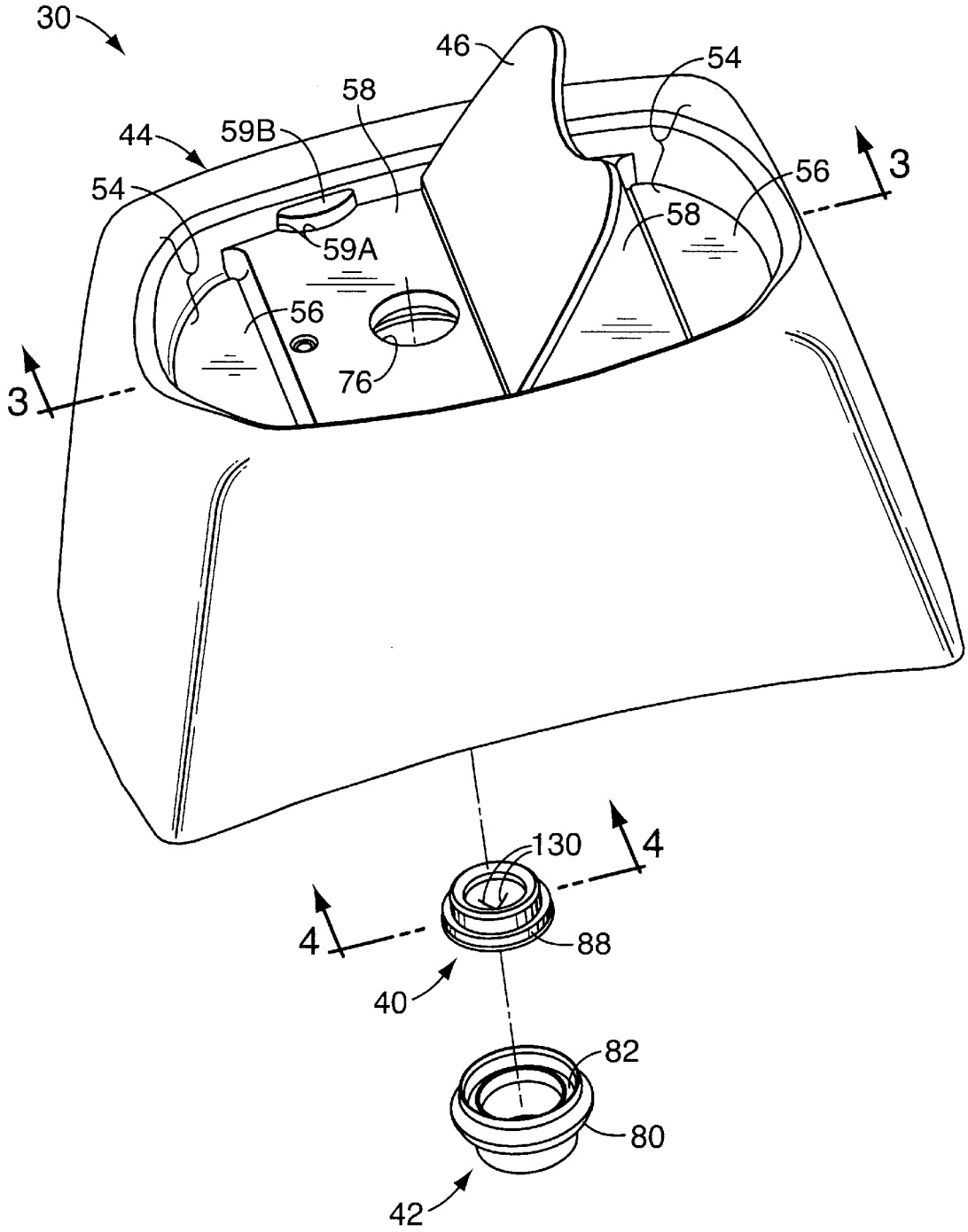
FIG. 2 is an exploded, perspective view of the closure illustrated in FIG. 1.
Figure 3:
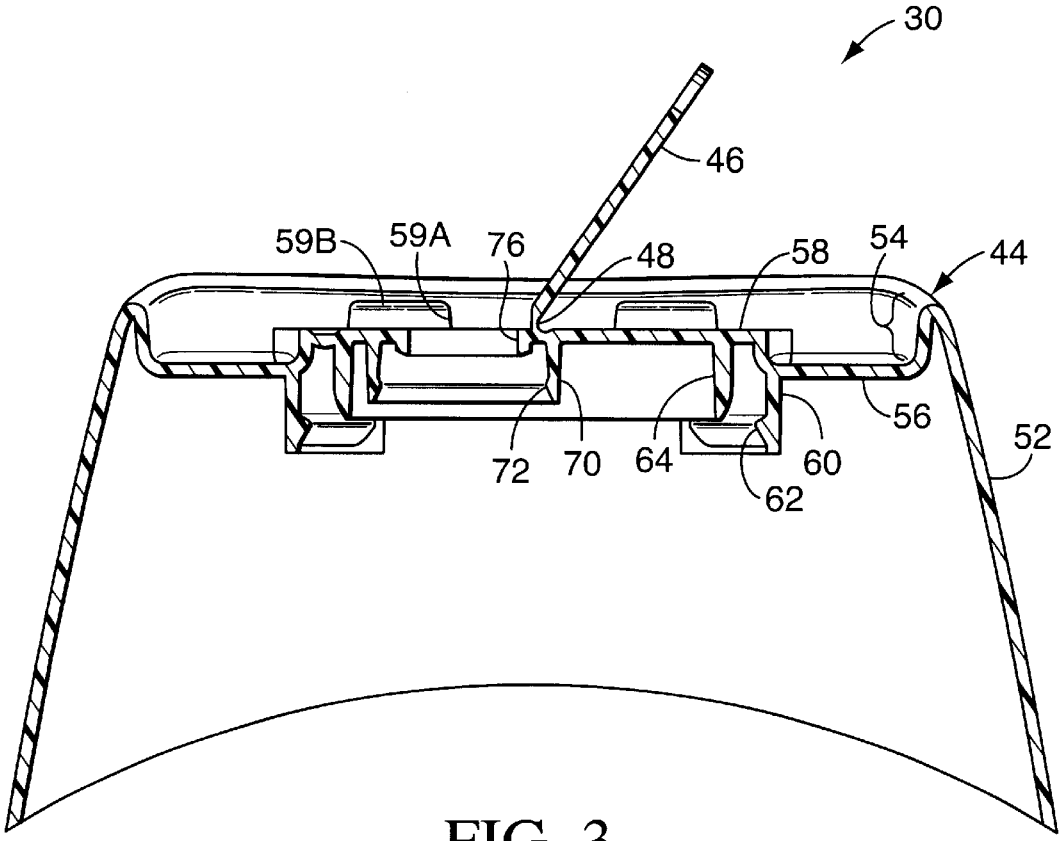
FIG. 3 is a cross-sectional view of the closure body taken generally along the plane 3—3 in FIG. 2.

As can be seen in FIG. 2, the illustrated preferred embodiment of the closure system 20 includes three basic components, (1) a housing 30, (2) a valve 40 which is adapted to be carried on the housing 30, and (3) a retainer 42 for securing the valve 40 in the housing 30. As can be seen in FIG. 3, the housing 30 is a unitary structure having a body 44, a lid 46, and a hinge 48 connecting the lid 46 to the body 44. The hinge 48 accommodates movement of the lid 46 between an as-molded open position illustrated in FIGS. 1–3 and a fully closed position illustrated in FIGS. 7 and 8.

As can be seen in FIG. 3, the closure housing 30 includes a skirt 52. As shown in FIG. 7, the skirt 52 is configured to surround, and extend downwardly around, an upper portion of the container neck 26 when the closure 20 is properly mounted on the container 22. As shown in FIG. 7, an internal, peripheral wall extends downwardly from the upper edge of the skirt 52 and defines a peripheral rim 54. The bottom of the rim 54 terminates at a generally horizontal deck 56. In the central region of the deck 56, there is a raised platform 58. The platform 58 is a unitary extension of the deck 56 and therefore may be characterized as, or regarded as, a part of the deck 56.

Figure 8:
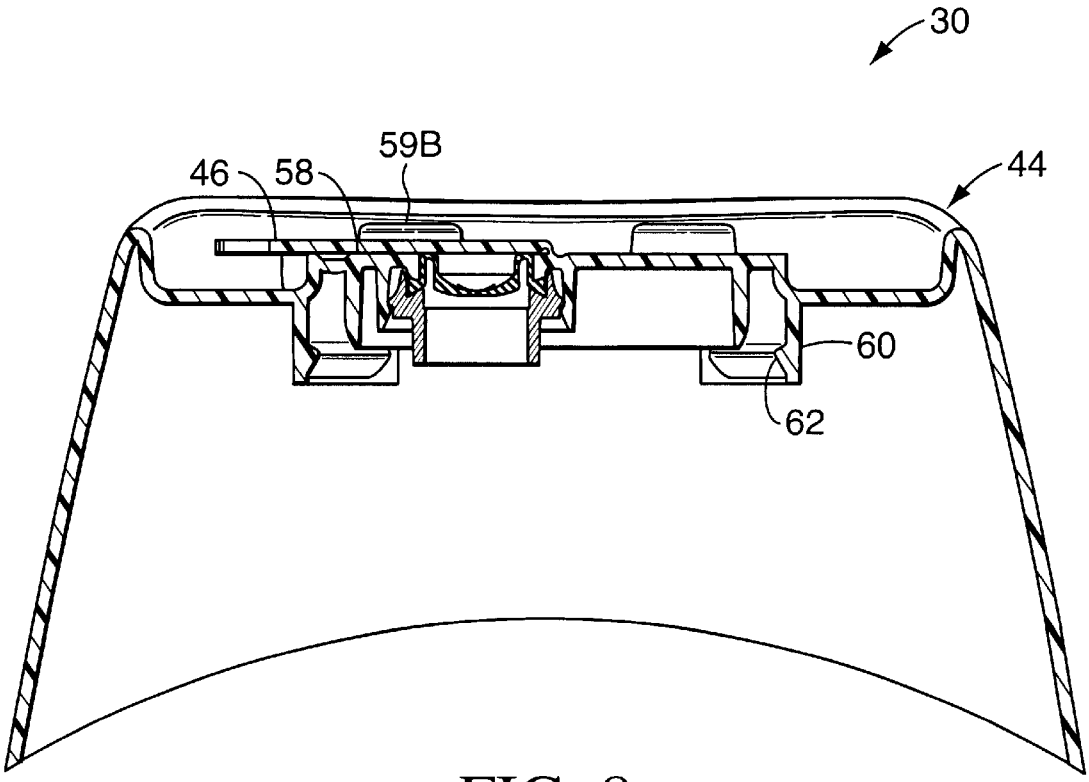
FIG. 8 is a view similar to FIG. 7, but FIG. 8 omits the container neck so as to reveal structure details of the container mounting portion regions of the closure body.

As shown in FIG. 2, adjacent portions of the rim 54 and deck 56 define openings or apertures 59A, and a tab 59B projects outwardly from the rim 54 over each aperture 59A. Preferably, there are at least two such tabs 59B, one on each side of the closure body 44, for holding the lid 46 in the closed position with a snap-fit engagement (FIGS. 7 and 8). To this end, the upper surface of each tab 59B is convex (as viewed from above the closure body 44 in FIG. 2), and the tab surface curves downwardly toward the deck platform 58.

When the lid 46 is moved toward the closed position, the bottom edge of the lid 46 engages the convex surface of each tab 59B. Owing to the resiliency of the closure body 44, the tabs 59B and/or the rim 54 can temporarily deform or deflect outwardly a sufficient amount to accommodate the movement of the lid 46 past the tabs 59B to the fully closed position on the deck platform 58 as illustrated in FIGS. 7 and 8.

After the lid 46 has moved or snapped downwardly past the tabs 59B, the tabs 59B move from the temporarily outwardly deflected positions back to the normal, unstressed positions, so that an outer portion of each tab 59B extends over, and confronts, a marginal portion of the lid 46 to thereby retain the lid 46 in the closed configuration (FIGS. 7 and 8).

Extending downwardly from, and below, the deck 56 (FIG. 7) is a generally annular wall 60. Near the bottom edge of the wall 60 is an inwardly projecting snap-fit bead 62 which is adapted to engage the lower edge of the container neck bead 29 as shown in FIG. 7. The wall 60 is sufficiently resilient to accommodate a snap-fit engagement which permits the bead 62 to initially slide against, then downwardly beyond, the edge of the container neck bead 29 so that the bead 62 then moves inwardly owing to the resiliency of the wall 60 to effect a snap-fit engagement between the bead 62 and container neck bead 29 as shown in FIG. 7.

Alternatively, the closure wall 60 could be provided with some other container connecting means, such as a groove (not illustrated) or a thread (not illustrated) for engaging a container neck thread (not illustrated). The closure housing 30 could also be permanently attached to the container 22 by means of induction melting, ultrasonic melting, gluing, or the like, depending on materials used for the closure housing 30 and container 22. The closure housing 30 could also be formed as a unitary part, or extension, of the container 22.

The closure body skirt 52 and wall 60 may have any suitable configuration for accommodating an upwardly projecting neck 26 or other portion of the container 22 received within the particular configuration of the closure body 30, and the main part of the container 22 may have a different cross-sectional shape than the container neck 26 and closure body housing.

Also, if desired, and as shown in FIG. 7, the closure body 44 may be provided with an annular seal 64 extending downwardly from the underside of the closure body deck platform 58 for sealingly engaging the container neck 26. Such a seal 64 could be a plug seal as shown, or a "crab's claw" profile seal, or some other such seal, depending upon the particular application.

With continued reference to FIG. 3, the closure body 44 also includes a reduced diameter, annular wall 70. At the lower end of the wall 70, there is an inwardly extending lip or bead 72 for engaging the retainer 42.

Figure 6:
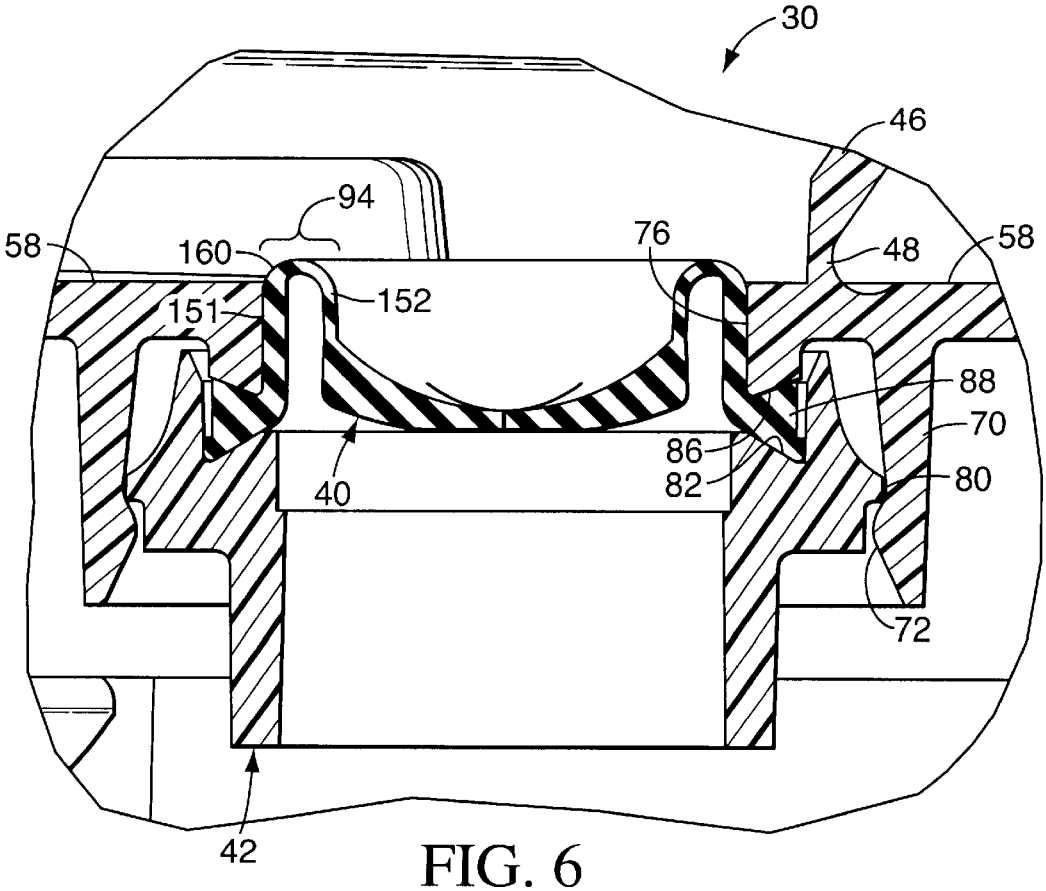
FIG. 6 is a greatly enlarged, fragmentary, cross-sectional view of the portion of the closure containing the closure body dispensing orifice and valve disposed therein, said cross-sectional view being taken along the plane 6—6 in FIG. 1.

As can be seen in FIG. 2, the closure housing body platform 58 on the deck 56 defines an aperture 76. As can be seen in FIG. 6, the aperture 76 is adapted to receive the valve 40 which is held in position against the platform 58 by the retainer 42. As shown in FIG. 2, the retainer 42 has a generally annular configuration with a peripheral snap-fit bead 80. The snap-fit bead 80 is adapted to be engaged by the closure body bead 72 as shown in FIG. 6. The closure body wall 70 from which the closure body bead 72 projects is sufficiently resilient to accommodate temporary outward expansion or deflection as the retainer 80 is pushed upwardly within the wall 70. The bead 72 is configured with an appropriate tapered surface so that the retainer bead 80 can slide along the bead 72 upwardly and then past the bead 72 until the resiliency of the wall 70 causes a bead 72 to snap back inwardly beneath the retainer bead 80 in a secure, snap-fit engagement.

As can be seen in FIG. 6, the upper portion of the retainer 42 has a frustoconical, tapered surface 82 for engaging a peripheral portion of the valve 40. As shown in FIG. 6 around the periphery of the closure body aperture 76, the deck 58 includes a downwardly projecting portion defining a frustoconical or tapered seating surface 86. The seating surface 86 cooperates with the retainer surface 82 to clamp the peripheral portion of the valve 40 in a seal-tight engagement within the closure housing 30.

The peripheral portion of the valve 40 may be characterized as a flange 88 having a generally dove-tail configuration when viewed in vertical cross section as shown in FIG. 6.

In alternate embodiments (not illustrated), the valve flange 88 could have other shapes, and the valve 40 could be retained within the closure system 20 in other ways. For example, instead of including the separate retainer 42, the closure system 20 could instead employ merely a deformable annular wall similar to the wall 70 that is unitary with, and projects downwardly from, the underside of the closure body platform 58. Such a deformable wall could be deformed or crimped against the valve flange to hold the valve in place.

The valve 40 is preferably molded from an elastomer, such as a synthetic thermosetting polymer, including silicone rubber, such as the silicone rubber sold by Dow Corning Corp. in the United States of America under the trade designation DC 94-595HC. However, the valve 40 can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Figure 4:
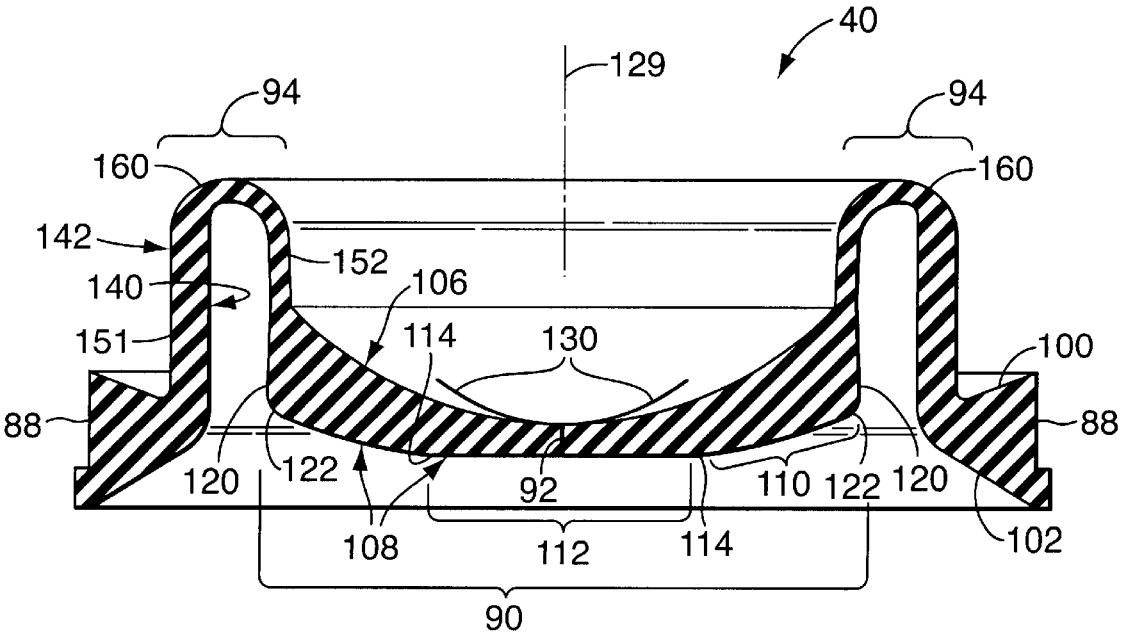
FIG. 4 is a greatly enlarged, cross-sectional view of the valve taken PRESSURE-ACTUATED VALVE AND LID SEAL generally along the plane 4—4 in FIG. 2.

As shown in FIG. 4, valve 40 includes, in addition to the marginal portion or flange 88, a valve head 90 with a discharge orifice 92 therein, and a connector sleeve 94 which has one end connected with valve flange 88 and the opposite end connected with the valve head 90 adjacent a marginal or peripheral surface thereof.

The connector sleeve 94 has a resiliently flexible construction, such that when pressure within a container is increased sufficiently, valve head 90 shifts outwardly to a fully extended position (FIG. 5) where the valve 40 becomes fully opened to accommodate discharge of the container contents.

With reference to FIG. 4, the illustrated dispensing valve 40 has an integrally formed or unitary, one-piece construction. The valve 40 is preferably molded from a resiliently flexible material, and in the illustrated example the material comprises a silicone rubber which is substantially inert so as to avoid reaction with, and/or adulteration of, the product being packaged. In one contemplated method of manufacturing the valve 40 of the present invention, the valve 40 is produced at relatively high speeds by the molding of liquid silicone rubber.

In the illustrated preferred embodiment, the marginal flange 88 of the valve 40 has an annular plan shape, and the valve flange 88 has a substantially dove-tail cross-sectional configuration with an outer or first frustoconical surface 100, and an inner or second frustoconical surface 102. The marginal valve flange 88 has substantial thickness between the outer, or first, frustoconical surface 100 and the inner, or second, frustoconical surface 102 which is resiliently compressed by the retainer 42 upon mounting the valve 40 in the closure so as to form a secure leak-resistant seal therebetween.

The valve 40 has a head portion 90 (FIG. 4), which has a circular plan shape, and a generally tapered construction which is thicker at the radially outside portion of the valve head 90, and thinner at the radially inside portion thereof. This tapered construction assists in achieving the snap open action of the valve 40, as described below. More specifically, in the illustrated example, valve head 90 has an exterior side or surface 106 for interfacing with the ambient environment. The exterior surface 106 has an arcuately shaped side elevational configuration which opens or curves outwardly, toward the exterior of a container, and the surface 106 is defined by first, predetermined radius. The valve head exterior surface 106 extends continuously to the connector sleeve 94 which in turn extends from the periphery of the head 90 to the marginal portion or flange 88.

The valve head 90 also includes an interior side or surface 108 (FIG. 4) for interfacing with the product in a container. The valve head interior side surface 108 has a marginal portion 110 with an arcuately shaped side elevational configuration which opens or curves outwardly, toward the exterior of a container, and is defined by a second predetermined radius. The radius of the marginal portion 110 on interior surface 108 is larger than the radius of the exterior surface 106, such that the two surfaces converge toward the center of the valve head 90 at the center of the orifice 92, and provide the above-noted inwardly tapered construction of the valve head 90. The exterior surface radius and the interior surface radius may each be characterized as a spherical radius.

The interior surface 108 of the valve head 90 also includes a center portion or planar central area 112, which has a circular plan shape, with a substantially planar or flat side elevational configuration, oriented generally perpendicularly to the discharge orifice 92. The intersection of the valve head marginal portion 110 and planar central portion 112 of the valve head 90 defines a circular locus 114. The planar central portion 112 of the valve head 90 assists in improving the opening characteristic of the valve 40, as set forth below.

In the illustrated embodiment as shown in FIG. 4, the outer perimeter of the valve head 90 is preferably defined by a slightly tapered peripheral surface or marginal surface 120 which begins at a peripheral outer edge 122 of the head marginal portion 110, and extends outwardly therefrom with a slight taper, ultimately merging into the connector sleeve 94. The edge 122 may be characterized as a circular, peripheral edge. The outside diameter of valve head 90, as measured along peripheral edge 122, is substantially smaller than the inside diameter of the marginal flange 88. This spacing between the valve head 90 and the marginal flange 88 permits, among other things, the valve head 90 to shift freely in an axial direction along the central longitudinal axis 129 of the marginal flange 88.

In the illustrated preferred embodiment, the valve 40 has a generally circular configuration about such a central longitudinal axis 129 which can also be characterized as a longitudinal axis extending through the valve 40, and the orifice 92 is defined by a plurality of slits 130 radiating laterally from the longitudinal axis 129. Preferably, there are four slits 130. A lesser or greater number of slits 130 could be used. The slits 130 extend transversely through head portion 90 from the exterior side or surface 106 to the interior side or surface 108.

In the illustrated preferred embodiment, the slits 130 extend laterally from a common origin on the longitudinal axis 129 to define four flaps 132 (FIG. 5) which flex outwardly to selectively permit the flow of product from a container through the valve 40. Each slit 130 terminates in a radially outer end. In the illustrated preferred embodiment, the slits 130 are of equal length, although the slits could be of unequal length.

In the preferred embodiment, each slit 130 is planar and parallel to the central geometric axis 129 of the valve. Each slit 130 preferably defines a linear locus along the head portion exterior side 106 and along the head portion interior side 108. Preferably, the slits 130 diverge from an origin on the longitudinal axis 129 and define equal size angles between each pair of adjacent slits 130 so that the flaps 132 are of equal size. Preferably, four slits 130 diverge at 90° angles to define two mutually perpendicular, intersecting, longer slits. The slits 130 are preferably formed so that the opposing side faces of adjacent valve flaps 132 closely seal against one another when discharge orifice 92 is in its normal, fully closed position. The length and location of the slits 130 can be adjusted to vary the predetermined opening pressure of the valve 40, as well as other dispensing characteristics.

It is to be understood that the orifice 92 may assume many different shapes, sizes and/or configurations in accordance with those dispensing characteristics desired. For example, orifice 92 may also include five or more slits, particularly when larger or wider streams are desired, and/or the product is a particulate material or a liquid containing aggregates.

The connector sleeve 94 is in the form of a rolling diaphragm, having a generally U-shaped cross-section defining an interior surface 140 and an exterior surface 142 (FIG. 4). The connector sleeve 94 has a first leg 151 (FIG. 4) that is connected with the flange 88, and has a second leg 152 (FIG. 4) that is connected with the head portion 90 of the valve 40. The second leg 152 is preferably shorter than the first leg 151.

The thickness of each leg may vary, and the thickness of the first leg 151 may be the same as the thickness of the second leg 152. However, in the illustrated preferred embodiment, the first leg 151 and the second leg 152 are each of substantially uniform thickness, with the first leg 151 being thicker than the second leg 152. In accordance with a preferred embodiment, the thickness of first leg 151 is about 0.015 inches and the thickness of second leg 152 is about 0.007 inches. Other thicknesses could be employed, depending on the material from which the valve sleeve 94 is constructed, the type of product to be dispensed, and/or on the overall diameter or size of the valve.

In the illustrated preferred embodiment, the first leg 151 and second leg 152 are substantially parallel to one another, and both are oriented substantially perpendicular to a horizontal plane passing through the valve head 90. The first leg 151 extends axially outwardly from an inner portion of the marginal flange 88. The second leg 152 has an end portion that extends axially outwardly from the marginal portion 110 of the valve head 90 so as to be generally contiguous with, and merge with, marginal surface 120 of the valve head 90.

The connector sleeve 94 locates the valve head 90 so that a horizontal plane passing through the valve head 90 extends through or outside of the marginal flange 88. The term "horizontal plane" is used herein with reference to a vertically oriented dispensing valve 40 as shown in FIG. 4. Such a plane may also be characterized as a plane that. is generally normal or perpendicular to the valve discharge flow path or direction.

The connector sleeve 94 may also be characterized as having a short, arcuate junction portion 160 (FIG. 4) joining the long first leg 151 to the short second leg 152 (which is parallel to the first leg 151 when the valve 40 is in the unactuated configuration (FIG. 4)).

The dispensing valve 40 is preferably configured for use in conjunction with a particular container, and a specific type of product, so as to achieve the exact dispensing characteristics desired. For example, the viscosity and density of the fluid product are both important factors in designing the specific configuration of the valve 40 for liquids, as is the shape, size, and strength of the container. The rigidity and durometer of the valve material, and size and shape of both the valve head 90 and the connector sleeve 94, are also important in achieving the desired dispensing characteristics, and can be matched with both the container and the material to be dispensed therefrom.

The valve 40 is suitable for dispensing flowable products, such as liquids or even gases, powders, particulates, or granular material, as well as suspensions of solid particles in a liquid. The valve 40 is particularly suitable for dispensing shampoos, liquid toothpaste, thin oils, thick lotions, water, and the like.

It is to be understood that, according to the present invention, the valve 40 may assume different shapes and sizes, particularly in keeping with the type of container and product to be dispensed therefrom. The predetermined opening pressure of the valve 40 may be varied widely in accordance with those dispensing criteria desired for a particular product. Flow characteristics of the dispensed product can also be adjusted substantially, such as for relatively wide column-like streams, thin needle-like streams, multiple streams, variations thereof, and the like.

In operation, the valve 40 finctions in the following manner. The valve 40 normally assumes an initial, protruding orientation illustrated in FIG. 4, wherein the valve 40 remains substantially in its original molded shape without deformation, with the connector sleeve 94 being substantially unstressed and the valve discharge opening 92 being fully closed. When the valve 40 is mounted in the closure 20 as is shown in FIG. 1, the valve 40 is configured such that discharge orifice 92 will remain securely closed after the container is inverted and the lid 46 opened, even under the hydraulic head pressure applied thereto by the weight of a fluid product when the container is completely full.

When additional pressure is established in the interior of the container, such as by manually flexing the container sidewalls inwardly, the connector sleeve 94 begins to distort, and the valve head 90 begins to shift axially outwardly.

Figure 5:
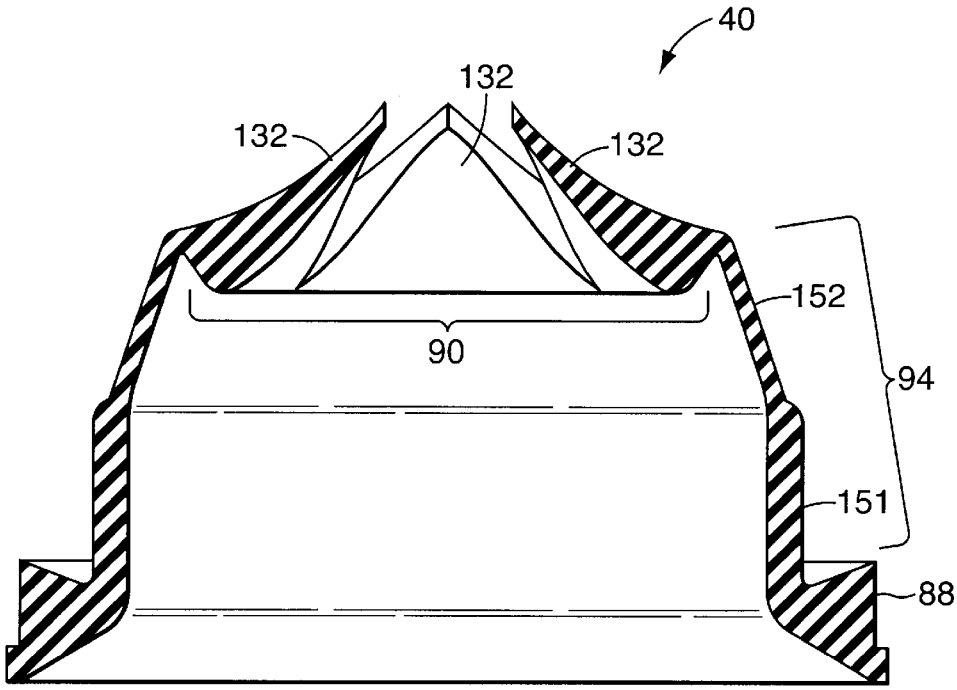
FIG. 5 is a view similar to FIG. 4, but FIG. 5 shows the valve opening when subjected to a pressure differential across the valve.

As the interior of the container is subjected to additional pressure, the valve head 90 continues to move outwardly until the connector sleeve 94 is substantially fully extended, as illustrated in FIG. 5. When the valve head 90 is in the substantially fully extended position (FIG. 5), the connector sleeve 94 is highly stressed.

When the interior of the container is subjected to further increased pressure, the valve head 90, per se, continues to shift outwardly. However, because connector sleeve 94 is already substantially fully extended, further outward shifting of the valve head 90 longitudinally tensions or stretches the connector sleeve 90, thereby increasing the outwardly directed torque applied to the valve head 90. Also, the further outward movement of the valve head 90 tends to flatten or straighten the valve head 90, particularly along the exterior surface 106 thereof. This flattening motion tends to slightly enlarge or dilate the circular plan configuration of the valve head 90, which enlargement is in turn resisted by radially inwardly directed forces applied to the marginal surface 120 of the valve head 90 by the connector sleeve 94, thereby generating another complex pattern of stresses within the valve 40, and these include stresses which tend to compress the valve head 90 in a radially inward direction. Due to the tapered shape of the valve head 90, the majority of compression strain is believed to take place adjacent the planar central portion 112 of the valve head 90.

When additional pressure is applied to the interior of the container, the valve head 90 continues to shift outwardly by further longitudinal stretching of the connector sleeve 94, and further enlargement of the plan shape of the valve head 90. The marginal edge 122 of the valve head 90 is elastically deformed further inwardly, as a consequence of the increased torque forces applied thereto by the connector sleeve 94. These combined forces and motions also serve to further compress the valve head 90 into a state of bifurcation, wherein the combined forces acting on the valve head 90 will, upon application of any additional outward force on the interior side 108 of the valve 40, cause the valve 40 to quickly open outwardly by separating the valve flaps 132 in the manner illustrated in FIG. 5, and thereby dispense the product through discharge orifice (typically with the container and closure turned generally upside down). The valve 40 continues to open to the full open configuration shown.

The bifurcation state of the valve 40, as the term is used herein, defines a relatively unstable condition which the valve 40 assumes immediately prior to the valve flaps 132 starting to open. As the valve 40 passes through the bifurcation state, the combined forces acting on the valve head 90 are in a temporary, unstable condition of equilibrium, and then quickly shift the valve head 90 into a generally convex shape, simultaneously opening the valve flaps 132 to create the open orifice. In the bifurcation state, the valve head 90 assumes the shape of a nearly planar disc (not illustrated), but with exterior surface 106 cupped and the interior surface 108 bent.

The provision of the first leg portion 151 of the connector sleeve 94 is such that, during dispensing of product through the open valve 40, the valve 40 extends outwardly of the closure 20 to allow for easier visibility to the consumer. The configuration of the connector sleeve 94 also minimizes the catching of dispensed product on the outside of the closure 20, even when the inverted container is tipped back over to a thirty degree angle from vertical during dispensing.

The thickness of the valve head 30 and length of the valve slits 130 can be selected so that the open valve either snaps closed when the pressure differential decreases to a predetermined level or remains fully open even when the pressure differential drops to zero.

Figure 9:
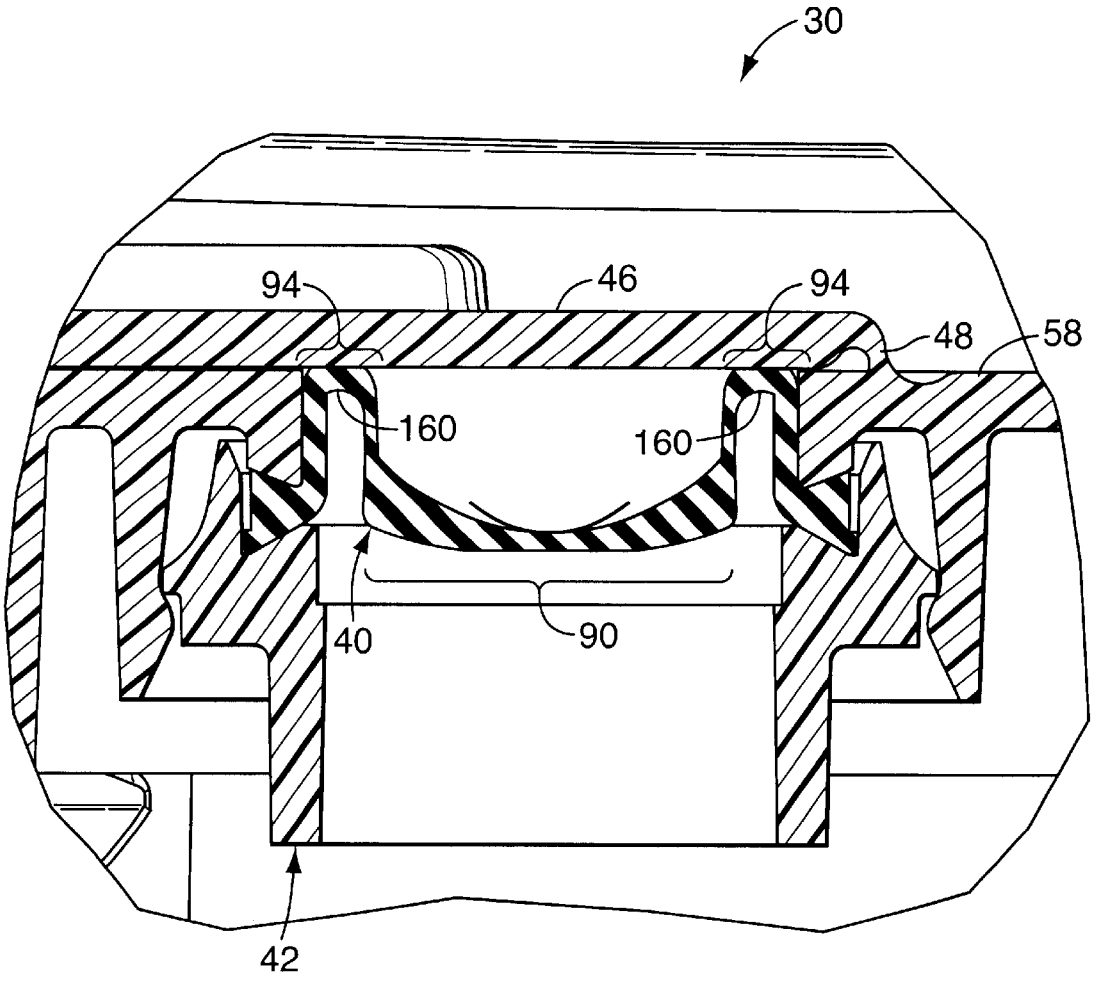
FIG. 9 is a greatly enlarged, fragmentary, cross-sectional view of the closure body dispensing orifice and valve similar to FIG. 6, but FIG. 9 shows the lid in a fully closed position.

With reference to FIG. 6, it can be seen that when the lid 46 is open and the valve 40 is in the unactuated, retracted, rest position, the valve sleeve 94 is situated and configured such that the arcuate junction portion 160 has a generally outwardly protruding, convex configuration when viewed from outside the closure body and projects from the deck aperture 76 beyond at least a portion of the platform 58 which is part of the deck 56 (FIG. 1). The arcuate junction portion 160 of the valve 40 has a generally outwardly facing surface for being engaged by the lid 46 to elastically deform the junction portion 160 inwardly when the lid is in the closed position (FIG. 9). This prevents the connector sleeve 94 from rolling far enough outwardly with the head portion 90 to a position where the valve orifice might tend to open when subjected to a sufficient differential pressure. Because outward movement of the valve head 90 is prevented by the closed lid 46, the lid 46 need not be provided with a separate seal post projecting downwardly into the valve 40. Thus, the interior side of the lid 46 can be made generally flat.

As shown in FIG. 3, because the interior surface of the lid 46 can be generally planar or flat, and because the exterior surface of the lid 46 can be generally planar or flat, the lid 46 can be molded as a unitary part of the closure housing at an oblique angle relative to the closure deck platform 58. This permits the various structural features of the closure housing 30 to be readily molded with mold components that can be of relatively simple construction and which can be employed in the mold assembly without side action operation. This permits a more simple mold assembly to be employed.

As shown in FIG. 6, the exterior vertical surface of the first leg 151 confronts, and is adjacent, the generally cylindrical sidewall of the closure body aperture 76. However, it is contemplated that in an alternate embodiment (not illustrated), there may be an annular gap or space between the exterior of the first leg 151 and the cylindrical aperture 76.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure system for a container that has an opening to the container interior where a product may be stored, said dispensing closure system comprising:

a body for extending from said container at said opening, said body including a deck defining an aperture;

a lid movable between a closed position confronting said deck and an open dispensing position moved away from said closed position; and a dispensing valve disposed with respect to said body at said deck aperture, said valve including:

(a) a marginal portion sealingly engaged with said body and retained at said body;

(b) a head portion that (1) is laterally inwardly of said marginal portion, (2) has an exterior side for interfacing with ambient environment, and (3) has an interior side for interfacing with the product, said head portion including a normally closed orifice which opens to permit flow therethrough in response to a pressure differential across said valve; and (c) a resilient, flexible, connector sleeve having an interior surface for interfacing with the product and having an exterior surface for interfacing with ambient environment, said connector sleeve having (1) a first leg connected with said marginal portion, (2) a second leg connected with said head portion to locate said head portion spaced laterally inwardly of said first leg to facilitate outward movement of said head portion when dispensing product from the container, and (3) an arcuate junction portion joining said first and second legs, said arcuate junction portion having a generally outwardly protruding, convex configuration when viewed from outside of said body, said valve being positioned on said body so that said junction portion projects from said deck aperture beyond at least a portion of said deck when said valve orifice is closed but said lid is in said open dispensing position, said arcuate junction having a generally outwardly facing surface for being engaged by said lid to elastically deform said junction portion inwardly when said lid is in said closed position thereby preventing said connector sleeve from rolling far enough outwardly with said head portion to a position where said valve orifice would open when subjected to a sufficient pressure differential.

2. The system in accordance with claim 1 in which said head portion exterior side has a generally concave shape when viewed from outside the container.

3. The system in accordance with claim 1 in which said system is a dispensing closure that is separate from, but releasably attachable to, said container around said opening.

4. The system in accordance with claim 3 in which said dispensing closure includes a body for mounting to said container; and said valve marginal portion is clamped within said body.

5. The system in accordance with claim 4 in which said valve marginal portion includes an annular flange having a generally dovetail cross-section defining a first diverging surface and a second diverging surface; and said body has an annular, frustoconical clamping surface engaging said first diverging surface of said valve flange.

6. The system in accordance with claim 1 in which said orifice is defined by a plurality of slits that extend (1) through said head portion between said exterior side and said interior side, and (2) laterally from a common origin whereby flaps are defined by said slits, said orifice opening by outward displacement of said flaps when the pressure in the interior of the container exceeds the pressure on the exterior of the valve by a predetermined amount;

said slits are each planar;

each slit defines a linear locus along said head portion exterior side and along said head portion interior side;

said slits are of equal length; and said slits diverge radially from said origin to define equal size angles between each pair of adjacent slits.

7. The system in accordance with claim 1 in which said second leg is shorter than said first leg;

each of said legs has a thickness which is substantially uniform;

said first leg is thicker than said second leg;

said sleeve has a generally circular configuration;

said first and second legs are substantially concentric;

said first leg extends axially outwardly from an inner portion of said marginal portion;

said second leg extends axially outwardly from an edge of said valve head portion; and said connector sleeve has a generally inverted U-shaped cross section.

8. The system in accordance with claim 1 in which (1) said orifice closes when the pressure on the interior of the container does not exceed the pressure on the exterior of the valve, and (2) said connector sleeve has a configuration which applies an outwardly directed torque to said valve head portion when the differential between the pressure within the container and the pressure on the exterior of the valve exceeds a predetermined amount.

9. The system in accordance with claim 1 in which said head portion interior side has a planar central area and a generally curved, radially outer portion which tapers toward said planar central area such that said exterior and interior sides converge toward said planar central area to provide a tapered construction with reduced thickness.

10. The system in accordance with claim 1 in which said deck has a generally planar region around said aperture; and said lid has a generally planar configuration and includes a generally planar surface that faces said valve when said lid is in said closed position.

11. The system in accordance with claim 1 in which said lid is hinged to said deck adjacent said deck aperture.

12. The system in accordance with claim 1 in which said lid is molded as a unitary part of said body.

13. The system in accordance with claim 1 in which said body and lid together define a releasable latch for releasably holding said lid in said closed position.

* * * * *